US010188147B2

(12) United States Patent
Liu

(10) Patent No.: US 10,188,147 B2
(45) Date of Patent: Jan. 29, 2019

(54) ATOMIZATION ASSEMBLY AND ELECTRONIC CIGARETTE

(71) Applicant: HUIZHOU KIMREE TECHNOLOGY CO., LTD. SHENZHEN BRANCH, Shenzhen, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days.

(21) Appl. No.: 15/515,606

(22) PCT Filed: Sep. 30, 2014

(86) PCT No.: PCT/CN2014/087986
§ 371 (c)(1),
(2) Date: Mar. 30, 2017

(87) PCT Pub. No.: WO2016/049876
PCT Pub. Date: Apr. 7, 2016

(65) Prior Publication Data
US 2017/0295847 A1 Oct. 19, 2017

(51) Int. Cl.
*A24F 47/00* (2006.01)
*F22B 1/28* (2006.01)
(Continued)

(52) U.S. Cl.
CPC ..... *A24F 47/008* (2013.01); *A24F 47/00* (2013.01); *F22B 1/284* (2013.01); *H05B 1/0297* (2013.01);
(Continued)

(58) Field of Classification Search
CPC ..... A24F 47/008
See application file for complete search history.

(56) References Cited

U.S. PATENT DOCUMENTS

2016/0000145 A1* 1/2016 Liu ..... A24F 47/008 131/329
2016/0000147 A1* 1/2016 Li ..... A24F 47/008 131/329
(Continued)

FOREIGN PATENT DOCUMENTS

CN 203633506 U 6/2014

OTHER PUBLICATIONS

International Search Report of PCT Patent Application No. PCT/CN2014/087986 dated Jun. 25, 2015.

*Primary Examiner* — James Harvey

(57) ABSTRACT

An atomization assembly and an electronic cigarette, the atomization assembly comprising an atomization core and an e-liquid cup assembly, the e-liquid cup assembly comprises an e-liquid storage sleeve and a vent pipe, and an e-liquid storage cavity is formed between them; the atomization core comprises an atomization sleeve and a heating wire assembly, a first e-liquid guide hole allowing e-liquid to flow is formed on a side wall of the atomization sleeve; the atomization core further comprises an e-liquid inlet control structure sleeved in the atomization sleeve rotatably or movably in an axial direction of the atomization sleeve, openings for mounting the heating wire assembly are arranged on the e-liquid inlet control structure, when the e-liquid inlet control structure is rotated or axially moved, the opening and the first e-liquid guide through-hole are communicated or completely staggered, so as to open or close the first e-liquid guide through-hole.

18 Claims, 10 Drawing Sheets

(51) Int. Cl.
*H05B 1/02* (2006.01)
*H05B 3/44* (2006.01)

(52) U.S. Cl.
CPC ..... *H05B 3/44* (2013.01); *H05B 2203/014* (2013.01); *H05B 2203/021* (2013.01); *H05B 2203/022* (2013.01)

(56) References Cited

U.S. PATENT DOCUMENTS

2016/0015082 A1* 1/2016 Liu ..... A24F 47/008 131/329
2016/0135504 A1* 5/2016 Li ..... A24F 47/008 392/395
2017/0295847 A1* 10/2017 Liu ..... A24F 47/008

* cited by examiner

ATOMIZATION ASSEMBLY AND ELECTRONIC CIGARETTE

FIELD OF THE INVENTION

The present application relates to a technical field of electronic heating products, and more particularly relates to an atomization assembly and an electronic cigarette.

BACKGROUND OF THE INVENTION

In the prior arts, an electronic cigarette comprises an atomization assembly for atomizing e-liquid and a battery assembly for providing electrical power, when the electronic cigarette is working, the battery assembly supplies the electrical power to heat generating element in the atomization assembly, and the heat generating element causes the e-liquid to be atomized to achieve an effect of producing smoke.

The prior art aerosol assembly includes an e-liquid cup assembly, a connection assembly, and an atomizing core. The heating wire assembly in the atomizing core continuously obtains the e-liquid from the e-liquid reservoir in the e-liquid cup assembly, the atomizing core is provided with a switch mechanism for sealing or opening the e-liquid guide hole. Then even in a non-smoking state, an e-liquid guide member in the heating wire assembly is always in communication with the e-liquid in the e-liquid reservoir, the e-liquid guide member is liable to cause a leakage of the e-liquid in a state of being saturated with the e-liquid, and it even leads to smoke non-atomized e-liquid when smoking, thereby affects user experience.

SUMMARY OF THE INVENTION

Technical problems to be solved in the present invention is to provide an atomization assembly and an electronic cigarette which can seal or open the e-liquid guide hole of the atomization core according to requirements in order to solve the defects in the prior art.

Technical problems to be solved in the present invention is to provide an atomization assembly, configured for forming an electronic cigarette with a battery assembly, wherein the atomization assembly comprises a suction nozzle assembly, an atomization core and an e-liquid cup assembly, the atomization core and the suction nozzle assembly are respectively arranged at two ends of the e-liquid cup assembly, the e-liquid cup assembly comprises an e-liquid storage sleeve and a vent pipe, the vent pipe is arranged in the e-liquid storage sleeve for discharging smoke obtained by an atomization of the atomization core to the suction nozzle assembly, an e-liquid storage cavity is formed between the e-liquid storage sleeve and the vent pipe, one end of the e-liquid storage sleeve is provided with an open end communicating with the e-liquid storage cavity, the atomization core is detachably connected to the e-liquid cup assembly and at least one end of the atomization core is inserted into the e-liquid storage cavity from the open end; the atomization core comprises an atomization sleeve and a heating wire assembly, the atomization sleeve is provided with an atomization cavity for receiving the heating wire assembly to atomize e-liquid, and a first e-liquid guide hole allowing the e-liquid in the e-liquid storage cavity to flow into the atomization cavity is defined on a side wall of the atomization sleeve; and the atomization core further comprises an e-liquid inlet control structure, the e-liquid inlet control structure is sleeved in the atomization sleeve rotatably or movably in an axial direction of the atomization sleeve, openings for mounting the heating wire assembly are arranged on the e-liquid inlet control structure, and when the e-liquid inlet control structure is rotated or axially moved, the openings and the first e-liquid guide hole are communicated or completely staggered, so as to open or close the first e-liquid guide hole.

In the atomization assembly provided in the present invention, the e-liquid inlet control structure comprises an atomization base and a connecting base, the connecting base is rotatably provided at one end of the atomization base, the openings are provided at the other end of the atomization base; the atomization base is abutted against the connecting base, abutting end surfaces of the atomization base and the connecting base are provided with mutually matched engaging structures, respectively, the engaging structures are configured for enabling the atomization base move along the axial direction of the atomization sleeve to communicate the first e-liquid guide hole with the heating wire assembly or to isolate the first e-liquid guide hole from the heating wire assembly, when rotating the connecting base.

In the atomization assembly provided in the present invention, the atomization base is elastically abutted against the connecting base.

In the atomization assembly provided in the present invention, the connecting base is rotatably sleeved outside the atomization base, an outer wall of the one end of the atomization base projects outwardly to form a first engaging portion, an inner wall of one end of the connecting base protrudes inwardly to form a second engaging portion, and the first engaging portion and the second engaging portion are the engaging structures whose surfaces are abutted against each other and matched with each other; the first engaging portion is provided with a plurality of first protrusions spaced apart from each other with a predetermined distance and first recesses located between the first protrusions, the second engaging portion is provided with a plurality of second protrusions spaced apart from each other with a predetermined distance and second recesses located between the second protrusions; the first e-liquid guide hole is communicated with the heating wire assembly when the connecting base is rotated to ensure the first protrusions are abutted against the second protrusions; the first e-liquid guide hole is isolated from the heating wire assembly by a side wall of the atomization base when the first protrusions are abutted against the second recesses.

In the atomization assembly provided in the present invention, an outer wall surface of the atomization base is provided with a guide projection along an axial direction of the atomization base, an inner wall surface of the connecting base is correspondingly provided with a guide groove matched with the guide projection.

In the atomization assembly provided in the present invention, end surfaces of the first protrusions are provided with positioning grooves or positioning protrusions; and end surfaces of the second protrusions are provided with positioning protrusions or positioning grooves matched with the first protrusions.

In the atomization assembly provided in the present invention, the atomization base is mutually abutted against an end surface of the connecting base, an end surface of the atomization base extends to form a first engaging portion in an axial direction toward to the connecting base; an end surface of the connecting base is provided with a second engaging portion configured for being mutually abutted against the first engaging portion; the first engaging portion is provided with a plurality of first protrusions spaced apart from each other with a predetermined distance and first recesses located between the first protrusions, the second engaging portion is provided with a plurality of second protrusions spaced apart from each other with a predetermined distance and second recesses located between the second protrusions; the first e-liquid guide hole is communicated with the heating wire assembly when the connecting base is rotated to ensure the first protrusions are abutted against the second protrusions; the first e-liquid guide hole is isolated from the heating wire assembly by a side wall of the atomization base when the first protrusions are abutted against the second recesses.

In the atomization assembly provided in the present invention, the e-liquid inlet control structure further comprises a first elastic member defined between the atomization base and the atomization sleeve, an outer wall surface of the atomization base is provided with a stopper flange, the outer wall surface of the atomization base is close to the first engaging portion, two ends of the first elastic member are respectively abutted against the stopper flange and an inner wall of the atomization sleeve.

In the atomization assembly provided in the present invention, the openings are U-shaped openings which are provided on an end surface of the atomization base, the end surface of the atomization base is opposite to the connecting base, and two ends of the heating wire assembly are respectively engaged in the openings.

In the atomization assembly provided in the present invention, the atomization core further comprises an internal electrode for supplying electrical power to the heating wire assembly, one end of the internal electrode is inserted in and fixed to the atomization base, and the other end of the internal electrode is elastically abutted against the battery assembly for elastically abutting the atomization base against the connecting base.

In the atomization assembly provided in the present invention, the e-liquid inlet control structure comprises an atomization base, a connecting base and a first elastic member, the atomization base moves along the axial direction of the atomization sleeve, the connecting base is fixedly defined at one end of the atomization sleeve, the first elastic member is defined between the atomization sleeve and the atomization base, an end surface of the atomization base is mutually abutted against an end surface of the connecting base, the openings are provided at the other end of the atomization base; the atomization core further comprises an internal electrode for supplying electrical power to the heating wire assembly, one end of the internal electrode is clamped and fixed in the atomization base, and the other end of the internal electrode is elastically abutted against the battery assembly; installing the battery assembly enables the atomization base to be axially moved until the first e-liquid guide hole is communicated with the heating wire assembly, and the first elastic member is compressed; with disassembling the battery assembly, under a restoring force of the first elastic member, the atomization base is axially moved until the first e-liquid guide hole is isolated from the electric heating wire assembly by a side wall surface of the atomization base.

In the atomization assembly provided in the present invention, an outer wall surface of the atomization base is provided with a stopper flange, two ends of the first elastic member are respectively abutted against the stopper flange and an inner wall of the atomization sleeve.

In the atomization assembly provided in the present invention, the internal electrode is elastically abutted against the battery assembly.

In the atomization assembly provided in the present invention, an inner wall of the atomization base protrudes inwardly to form a fixed projection, an outer wall of the internal electrode projects outwardly to form a raised portion, an end of the internal electrode passes through the fixed projection so that the raised portion is abutted against the fixed projection along the axial direction of the atomization sleeve.

In the atomization assembly provided in the present invention, the e-liquid inlet control structure comprises an atomization base rotationally inserted into the atomization sleeve, the openings are symmetrically arranged on the atomization base for mounting the heating wire assembly, two ends of the heating wire assembly are clamped in the openings; with a rotation of the atomization base, the openings are communicated with the first e-liquid guide hole or completely isolated from the first e-liquid guide hole.

In the atomization assembly provided in the present invention, the e-liquid inlet control structure further comprises a positioning pin, the positioning pin is detachably mounted on the atomization sleeve, the atomization base is provided with a positioning hole matched with the positioning pin.

In the atomization assembly provided in the present invention, the heating wire assembly comprises an e-liquid guide member for communicating with the first e-liquid guide hole, and a heating wire wound around the e-liquid guide member, the e-liquid guide member is configured for transferring the e-liquid obtained from the e-liquid storage cavity for the heating wire to heat and atomize.

The present invention further comprises an electronic cigarette, the electronic cigarette comprises the above atomization assembly and the battery assembly configured for supplying electrical power to the atomization assembly.

Applications of the atomization assembly and the electronic cigarette of the present invention have following advantages: The atomization core is provided with an e-liquid inlet control structure for sealing or opening the first e-liquid guide hole, and the user can, if necessary, close the first e-liquid guide hole communicated the e-liquid storage cavity and the atomization chamber when the electronic cigarette is not used, so that the heating wire assembly in the atomization chamber is separated from the e-liquid storage cavity to prevent the e-liquid guide member in the heating wire assembly from a problem of a leakage of the e-liquid due to a super saturation of the e-liquid and the like, thereby preventing the user from smoking non-atomized e-liquid when smoking and affecting user experience. In addition, since the atomization core and the suction nozzle assembly are respectively provided at two ends of the e-liquid cup assembly, the atomization core is detachably connected to the e-liquid cup assembly and at least one end is inserted from the open end of the e-liquid storage cavity, thereby not only facilitating a repair or replacement of the atomization core, and avoiding contamination of the suction nozzle assembly when the e-liquid is added from the open end to the e-liquid storage cavity.

BRIEF DESCRIPTION OF THE DRAWINGS

The present invention will be further described with reference to the accompanying drawings and embodiments in the following.

DETAILED DESCRIPTION OF THE PREFERRED EMBODIMENT

To make the technical feature, objective and effect of the present application be understood more clearly, now the specific implementation of the present application is described in detail with reference to the accompanying drawings and embodiments.

The present invention provides an atomization assembly configured for forming an electronic cigarette with a battery assembly, the battery assembly includes a battery for supplying electrical power to the atomization assembly, a control circuit board for controlling an operating state of the atomization assembly, battery electrodes for an electrical connection with the atomization assembly, and a battery sleeve for accommodating the battery, the control circuit board and the battery electrodes, since a relevant structure of the battery assembly in the present application belongs to the prior art, and it will not be described here.

Figure 1:
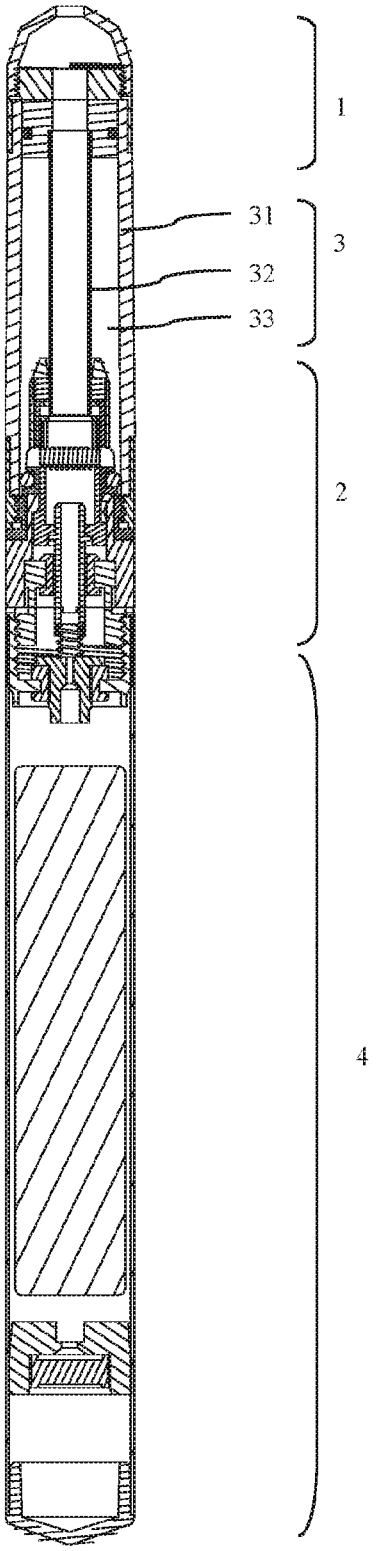
FIG. 1 is a structural schematic view of an electronic cigarette provided in a first preferred embodiment of the present invention
Figure 2:
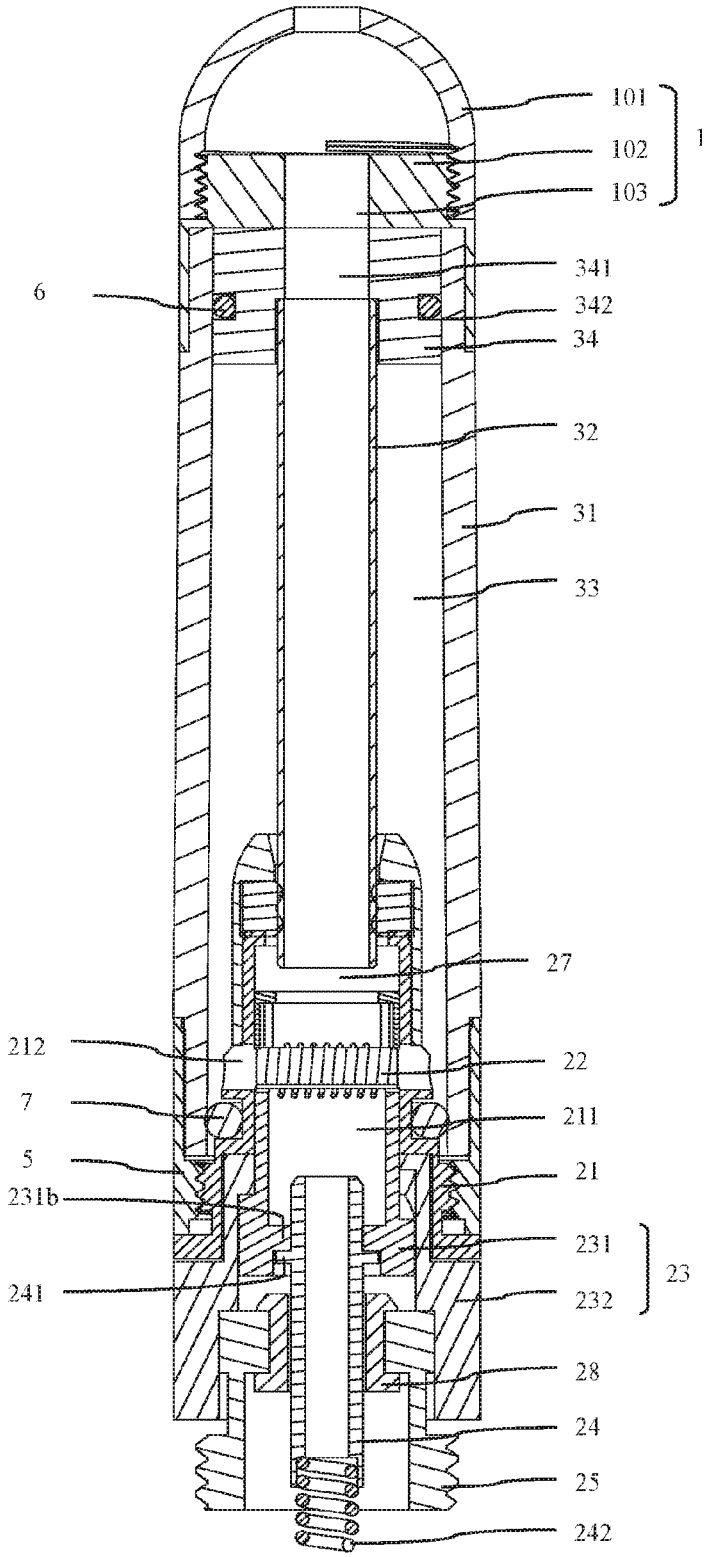
FIG. 2 is a structural schematic view of an atomization assembly in FIG. 1 in a working state.

Embodiment 1: Referring to FIGS. 1 and 2, and in Conjunction with FIGS. 3 to 8

The present embodiment provide an atomization assembly detachably connected to the battery assembly 4, the atomization assembly comprises a suction nozzle assembly, an atomization core 2 and an e-liquid cup assembly 3, the atomization core 2 and the suction assembly 1 are defined at two ends of the e-liquid cup assembly 3, respectively.

The suction nozzle assembly 1 has a smoking channel 103 through the suction nozzle assembly 1 for atomized smoke to flow into a mouth of an user, the suction nozzle assembly 1 comprises a suction nozzle cover 101 and a suction nozzle base 102 for allowing the user to directly inhale the smoke, the suction nozzle base 102 is configured for detachably connecting the suction nozzle cover 101 to the e-liquid cup assembly 3. In the present embodiment, one end of the suction nozzle base 102 is provided with an external thread structure for a connection with an internal thread provided on the suction nozzle cover 101; edge of the other end of the suction nozzle base 102 extends outwardly to form an annular sleeve, the annular sleeve is configured to sleeve at one end of the e-liquid cup assembly 3 and is connected to the e-liquid cup assembly 3 by an interference fit.

It is to be understood that the suction nozzle assembly 1 and the e-liquid cup assembly 3 may be integrally formed in addition to the above-described detachable connection, and exact connection methods are not particularly limited thereto.

The e-liquid cup assembly 3 includes an e-liquid storage sleeve 31, a vent pipe 32, and an e-liquid separator 34.

The e-liquid storage sleeve 31 is a hollow tubular structure, one end of the e-liquid storage sleeve 31 is detachably connected to the atomization core 2 through a connecting sleeve 5, and the other end of the e-liquid storage sleeve 31 is detachably connected to the e-liquid separator 34 and the suction nozzle base 102, respectively. In the present embodiment, the e-liquid separator 34 is inserted into an end of the e-liquid storage sleeve 31 to avoid a leaking of the e-liquid, and the suction nozzle base 102 is sleeved outside the e-liquid storage sleeve 31. An e-liquid storage cavity 33 for storing e-liquid is formed between the e-liquid storage sleeve 31 and the vent pipe 32, one end of the e-liquid storage sleeve 31 is provided with an open end communicating with the e-liquid storage cavity 33, the end of the e-liquid storage sleeve 31 is opposite to the e-liquid separator 34, at least one end of the atomization core 2 is inserted from the open end into the e-liquid storage cavity 33 and is resiliently connected to the vent pipe 32 to form a closed e-liquid storage cavity 33 in cooperation with the e-liquid storage sleeve 31, the vent pipe 32 and the e-liquid separator 34.

The vent pipe 32 is inserted axially into the e-liquid storage sleeve 31 for discharging the smoke atomized by the atomization core 2 out of the suction nozzle assembly 1. One end of the vent pipe 32 is connected to the atomization core 2 and the other end of the vent pipe 32 is connected to the e-liquid separator 34.

The e-liquid separator 34 provides a through hole 341 communicating the smoking channel 103, and the vent pipe 32 communicates with the through hole 341, so that smoke obtained by an atomization of the atomization core 2 can pass through the vent pipe 32, the through hole 341 and the smoking channel 103 sequentially to flow into the user's mouth.

Preferably, the atomization assembly further comprises a first sealing ring 6 defined between the e-liquid storage sleeve 31 and the e-liquid separator 34, the first sealing ring 25 is configured for preventing the e-liquid in the e-liquid storage cavity 33 from leaking out through a gap between the e-liquid storage sleeve 31 and the e-liquid separator 34, correspondingly, a first sealing groove 342 for receiving the first sealing ring 6 is provided on an outer side surface of the e-liquid separator 34 along a circumferential direction of the e-liquid separator 34.

Preferably, the e-liquid storage sleeve 31 is interference fitted with the e-liquid separator 34, then it is possible to minimize a leakage of the e-liquid and meanwhile to prevent the e-liquid separator 34 from being released.

Preferably, the atomization assembly further comprises a second sealing ring 7 defined between the e-liquid storage sleeve 31 and the atomization core 2, the second sealing ring 7 is configured for preventing the e-liquid in the e-liquid storage cavity 33 from leaking out through a gap between the e-liquid storage sleeve 31 and the atomization core 2.

The atomized core 2 provided in the present invention is detachably connected to the e-liquid storage sleeve 31 through the connecting sleeve 5, and one end of the atomization core 2 is inserted into the e-liquid storage cavity 33. It is to be understood that the entire atomization core 2 may be placed in the e-liquid storage cavity 33, namely, two ends are inserted into the e-liquid storage cavity 33.

The atomization core 2 specifically comprises an atomization sleeve 21 for connecting with the e-liquid storage sleeve 31, a heating wire assembly 22 for heating and atomizing the e-liquid, an e-liquid inlet control structure 23 for adjusting an open or a close of an e-liquid inlet, an internal electrode 24 and an external electrode 25 for supply electrical power to the heating wire assembly 22 and a smoke passage 27 for the atomized smoke to flow.

the smoke passage 27 is defined in the atomization sleeve 21, the heating wire assembly 22 is defined at the smoke passage 27, the e-liquid inlet control structure 23 is provided at an end of the atomization sleeve 21, an end of the internal electrode 24 is inserted into the e-liquid inlet control structure 23, the other end of the internal electrode 24 is electrically connected to the battery assembly 4.

Figure 3:
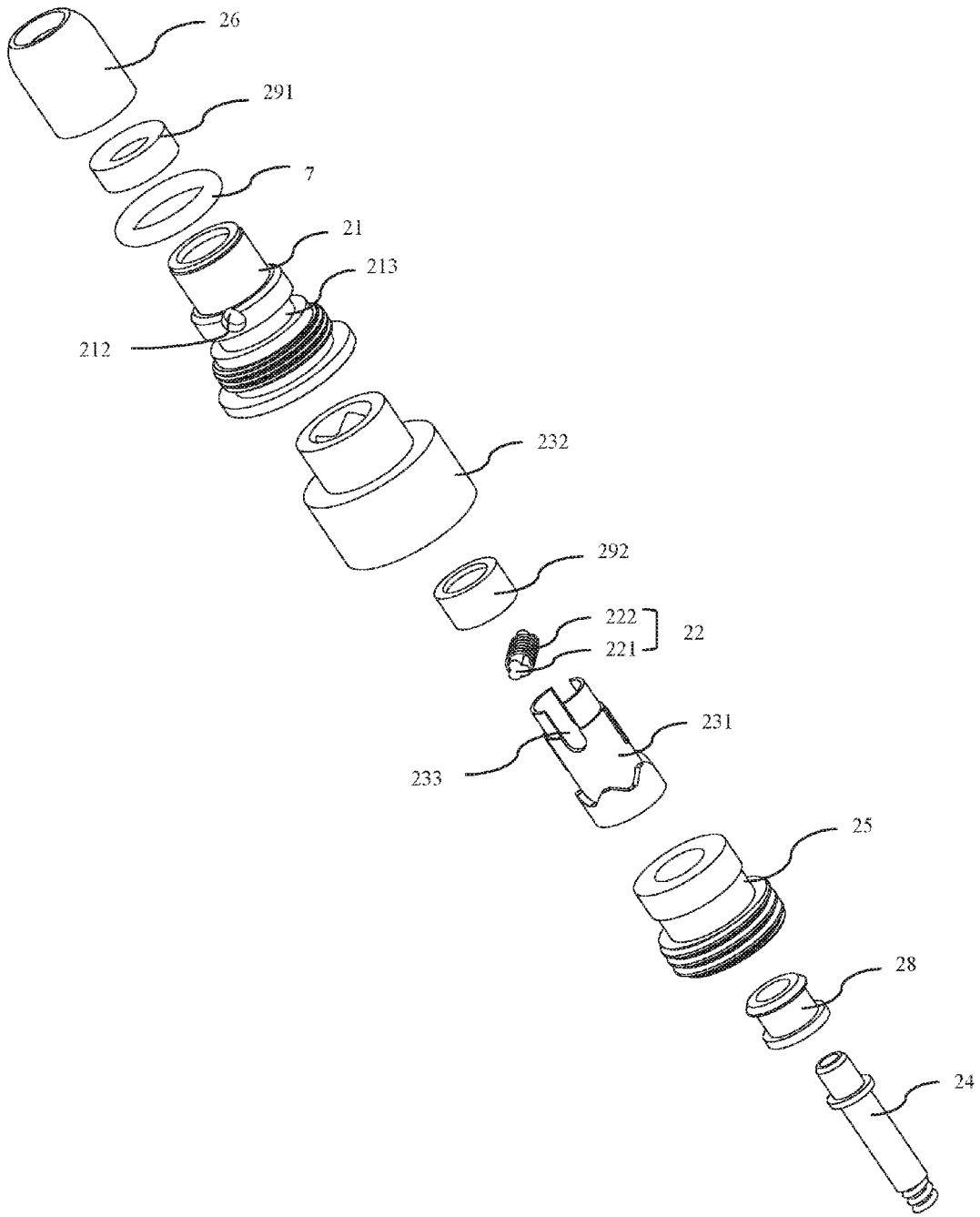
FIG. 3 is a three-dimensional split diagram of an atomization core in FIG. 1.

According to FIG. 3, the atomization sleeve 21 has a generally stepped tubular structure, a second sealing groove 213 for receiving the second sealing ring 7 is provided on an outer side surface of the atomization sleeve 21 along a circumferential direction of the atomization sleeve 21.

The e-liquid inlet control structure 23 is fixed at one end of the atomization sleeve 21 and is provided with a screw structure for detachably connecting with the connecting sleeve 5 for cooperating with the connecting sleeve 5 to clamp and fix the e-liquid storage sleeve 31.

The atomization sleeve 21 is provided with an atomization cavity 211 inside for receiving the heating wire assembly 22 to atomize e-liquid, and a first e-liquid guide hole 212 for allowing the e-liquid in the e-liquid storage cavity 33 to flow into the atomization cavity 211 is defined on a side wall of the atomization sleeve 21.

The smoke passage 27 penetrates the atomization core 2 in the axial direction to communicate the atomization cavity 211 and the vent pipe 32 so that outside air can enter the atomization cavity 211 and is sucked by the user through the vent pipe 32.

In the present embodiment, the e-liquid inlet control structure 23 comprises an atomization base 231 and a connecting base 232, one end of the atomization base 231 is inserted in the atomization sleeve 21 and is movable in an axial direction of the atomization sleeve 21, the connecting base 232 is rotatably provided at the other end of the atomization base 231.

Figure 4:
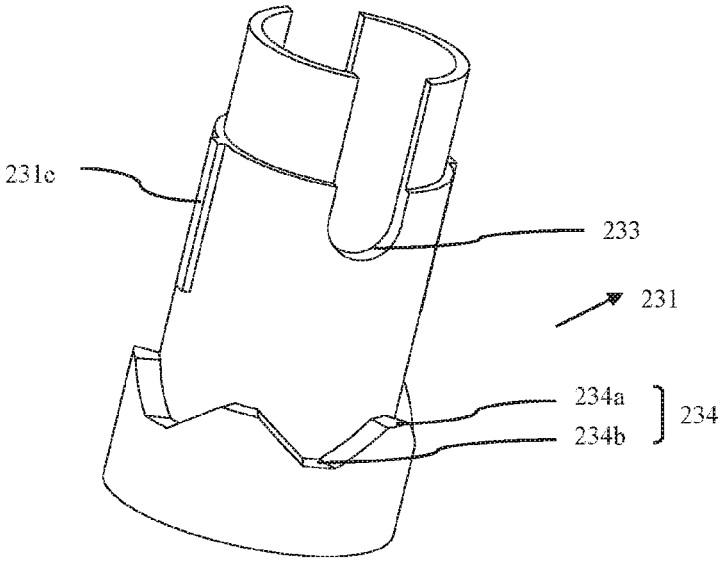
FIG. 4 is a perspective view of an atomization base in FIG. 1.

Combine FIG. 3 and FIG. 4, the heating wire assembly 22 comprises an e-liquid guide member 221 and a heating wire 222. The e-liquid guide member 221 is made of e-liquid absorbing materials, and is configured for transferring the e-liquid obtained from the e-liquid storage cavity 33 for the heating wire 222 to heat and atomize; the heating wire 222 is configured for communicating with the first e-liquid guide hole 212 and a heating wire 222 wound around and fixed at a part of the e-liquid guide member 221 and is electrically connected to the battery assembly, the part of the e-liquid guide member 221 is defined in the atomization base 231.

A pair of openings 233 are correspondingly arranged on a side wall of one end of the atomization base 231 for mounting the heating wire assembly 22, the openings 233 are preferably to be U-shaped openings matched with the heating wire assembly 22. Two ends of the e-liquid guide member 221 are inserted into the e-liquid storage cavity 33 through the openings 233, respectively, to absorb the e-liquid for the heating wire 222 to heat and atomize; the heating wire assembly 22 is defined on the smoke passage 27 and in the atomization cavity 211, and two ends of the heating wire assembly 22 are extended from the openings 233. When replacing the heating wire assembly 22, it is only necessary to directly place or displace the heater wire assembly 22 along the openings 233.

Figure 5:
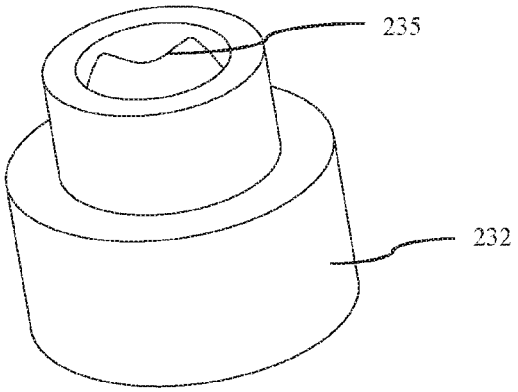
FIG. 5 is a perspective view of a connecting base in FIG. 1.
Figure 6:
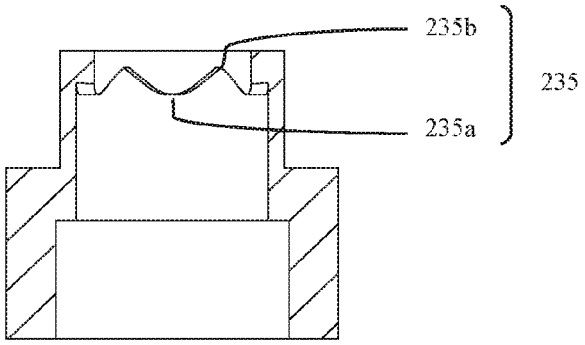
FIG. 6 is a cross-sectional view of the connecting base in FIG. 1.

Referring to FIG. 5, the connecting base 232 is generally a stepped hollow tubular structure, one end of the atomization base 231 is rotationally inserted into the atomization sleeve 21.

One end of the internal electrode 24 is inserted and fixed to the atomization base 231, and the other end of the internal electrode 24 is inserted into the external electrode 25. An inner wall of the atomization base 231 protrudes inwardly to form a fixed projection 231*b* for fixing the internal electrode 24, an outer wall of the internal electrode 24 projects outwardly to form a raised portion 241 for being abutted against the fixed projection 231*b*, an end portion of the internal electrode 24 passes through the fixed projection 231*b* so that the raised portion 241 is abutted against the fixed projection 231*b* along an axial direction of the atomization sleeve 21.

It is preferable that a detachable connection between the internal electrode 24 and the fixed projection 231*b* is performed in an interference fit manner, but the present invention is not limited thereto and may be a screw connection or the like.

In order to ensure an electrical isolation between the internal electrode 24 and the external electrode 25, the atomization core 2 in the present invention further comprises an insulating sleeve 28 interposed between the internal electrode 24 and the external electrode 25. It is to be understood that a method of electrically isolating is not limited to the use of the insulating sleeve 28, and an insulating medium or the like may be coated on an interface where the internal electrode 24 is in contact with the external electrode 25, and it is not limited thereto.

The external electrode 25 is also provided with an external thread structure for detachably connecting with the battery assembly 4, and the external electrode 25 is fixed to the internal electrode 24 by an engagement with the insulating sleeve 28, and moves with a move of the atomization base 231. It is to be understood that the external electrode 25 may be fixed in such a manner as to be in interference fit with the connecting base 232, and then the outer electrode 25 does not move axially with the atomization base 231 but rotates with a rotation of the connecting base 232. A specific connection method of the external electrode 25 may be selected depending on the actual situation, and is not limited thereto. In addition, the atomization core 2 also includes an atomization cap 26, a sealing sleeve 291 and a sealing base 292.

The atomization cap 26 is sleeved at one end of the atomization sleeve 21, the end is inserted into one end of the e-liquid storage sleeve 31, the atomization cap 26 is provided with a communication hole communicating with the smoke passage 27, the vent pipe 32 is inserted into the communication hole and is directly communicated with the smoke passage 27.

The sealing sleeve 291 is clamped between the atomization cap 26 and the vent pipe 32 for preventing the e-liquid in the e-liquid storage cavity 33 from flowing into the smoke passage 27 along a gap between the atomization cap 26 and the vent pipe 32.

The sealing base 292 is provided at an end of the vent pipe 32 for preventing the smoke from entering the atomization cavity 211.

The atomization base 231 is abutted against the connecting base 232, abutting end surfaces of the atomization base 231 and the connecting base 232 are provided with mutually matched engaging structures, respectively, the engaging structures are configured for causing the atomization base 231 move along an axial direction of the atomization sleeve 21 when rotating the connecting base 232.

Figure 7:
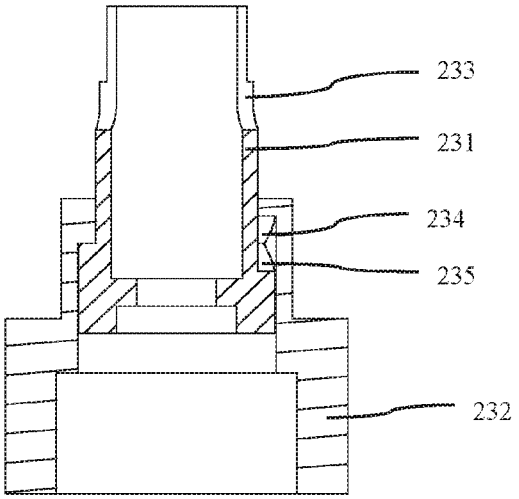
FIG. 7 is a structural schematic view of the connecting base and the atomization base when the atomization assembly is in operation in FIG. 1.

Combine FIG. 4 and FIG. 7, the engaging structures comprises a first engaging portion 234 provided on the atomization base 231 and a second engaging portion 235 provided on the connecting base 232, the second engaging portion 235 mates with the first engaging portion 234.

The first engaging portion 234 is provided at one end of the atomization base 231 opposite to the openings 233 and is formed by outwardly projecting from an outer wall of the atomization base 231, and the first engaging portion 234 extends from an end surface of the atomization base 231 opposite to the openings 233 to a direction that close to the openings 233.

The second engaging portion 235 is provided on an inner wall surface of the connecting base 232 for being sleeved outside the atomization base 231 and is formed by projecting inwardly from the inner wall surface of the connecting base 232, and the second engaging portion 235 extends from an end surface of the connecting base 232 close to the openings 233 to a direction that opposite to the openings 233.

The end surface of the first engaging portion 234 adjacent to the openings 233 and the end surface of the second engaging portion 235 opposite to the openings 233 abut against each other, and the two end surfaces are respectively provided with mutually convex portions or recesses for engaging with each other.

Specifically, the first engaging portion 234 is provided with a plurality of first protrusions 234*a* spaced apart from each other with a predetermined distance and first recesses 234*b* located between two adjacent first protrusions 234*a*, the second engaging portion 235 is provided with a plurality of second protrusions 235*a* spaced apart from each other with a predetermined distance and second recesses 235*b* located between two adjacent second protrusions 235*a*.

Figure 8:
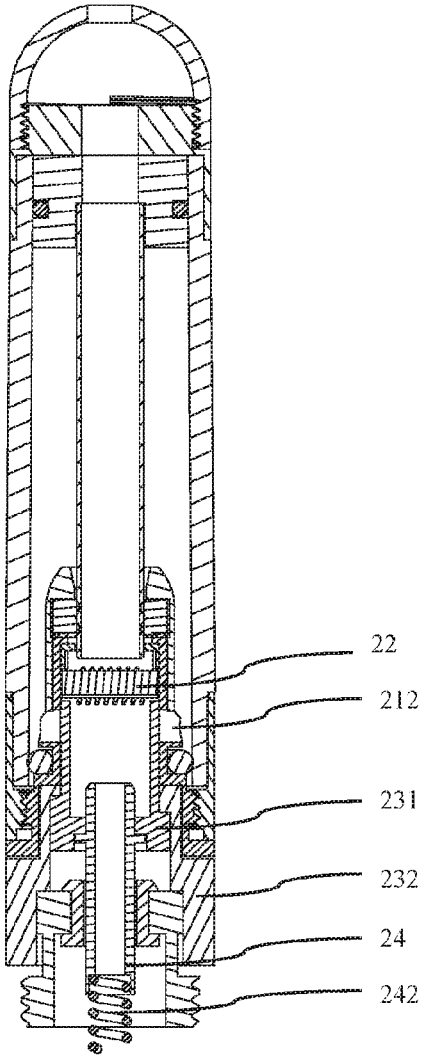
FIG. 8 is a structural schematic view of an atomization assembly in FIG. 1 in a non-working state.
Figure 9:
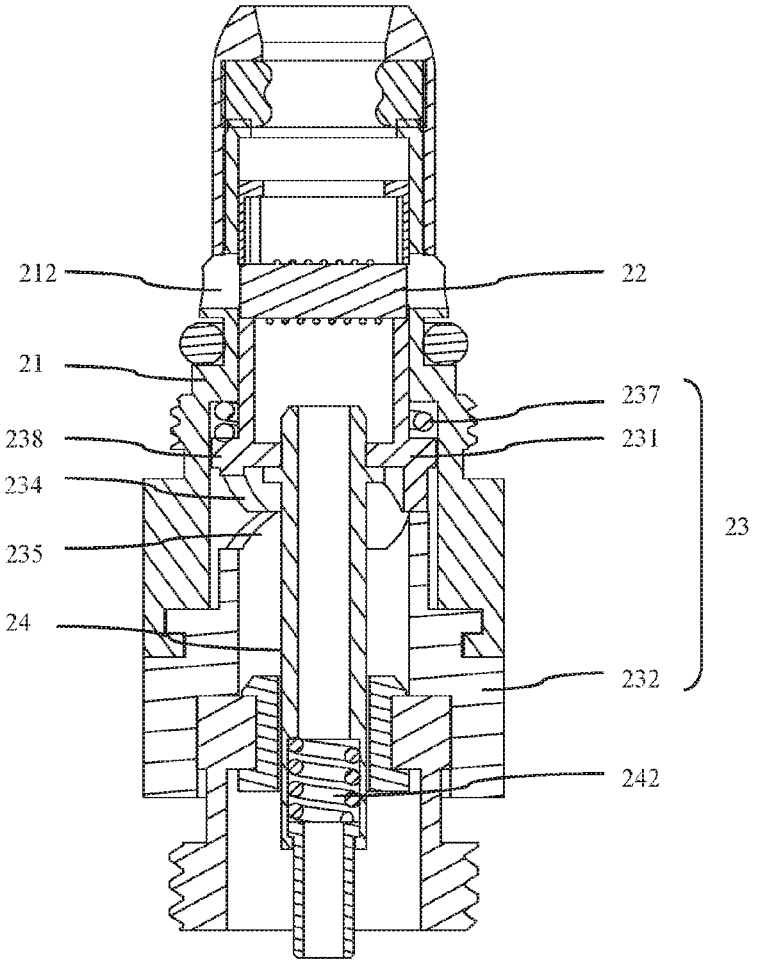
FIG. 9 is a structural schematic view of an atomization core when the electronic cigarette provided in a second preferred embodiment of the present invention is in an operating state.
Figure 10:
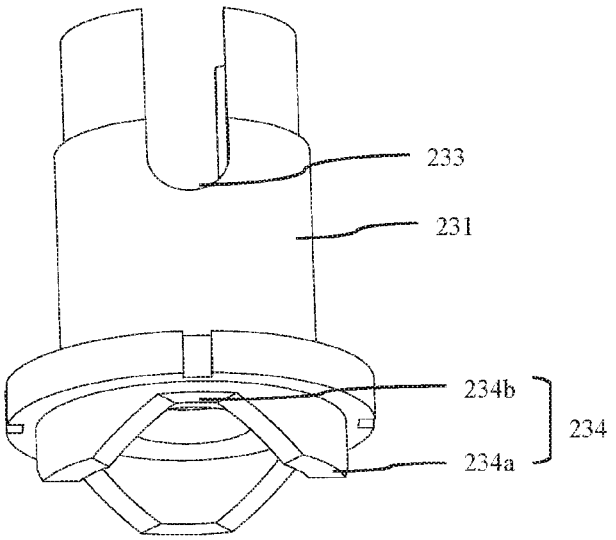
FIG. 10 is a perspective view of an atomization base in FIG. 9.
Figure 11:
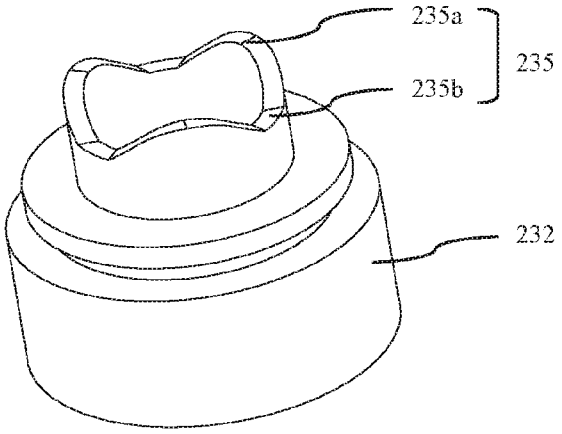
FIG. 11 is a perspective view of a connecting base in FIG. 9.
Figure 12:
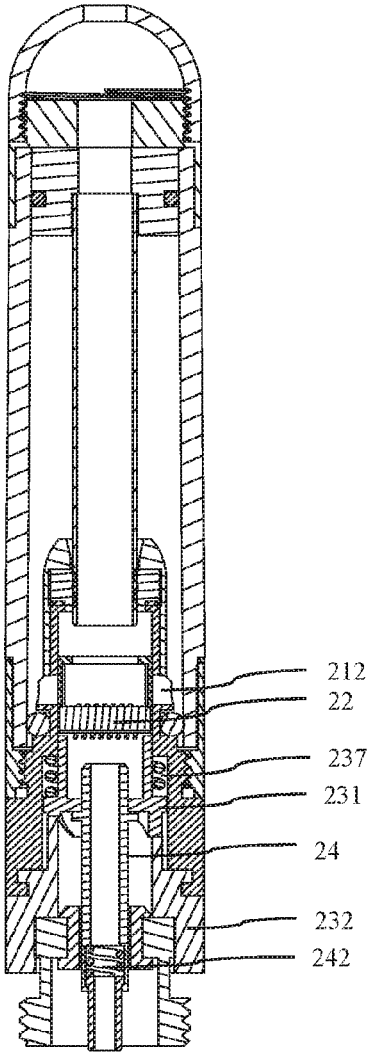
FIG. 12 is a structural schematic view of an atomization assembly in FIG. 9 in a non-working state.

Combine FIG. 7 and FIG. 8, rotates the connecting base 232 to enable the second engaging portion 235 to rotate with respect to the first engaging portion 234, the second protrusions 235*a* also switch between an abutting with the first protrusions 234*a* and an abutting with the first recesses 234*b* as the connecting base 232 rotates, thereby causing the atomization base 231 and the connecting base 232 to move relative to each other with the rotation of the connecting base 232.

In the present embodiment, the end for an abutment with the atomization base 231 on the connecting base 232 is abutted against the atomization sleeve 21 and cannot be moved in an axial direction of the atomization sleeve 21; and one end of the atomization base 231 in the connecting base 232 is movably connected to the connecting base 232 and is movable along an inner cavity of the connecting base 232. Therefore, the atomization base 231 is moved in the axial direction of the atomization sleeve 21 when the atomization base 231 and the connecting base 232 move relative to each other because of the rotation of the connecting base 232, as a result, the openings 233 are moved relative to the first e-liquid guide hole 212.

Rotate the connecting base 232, when the second protrusions 235*a* are abutted against the first protrusions 234*a*, a gap between the first engaging portion 234 and the second engaging portion 235 becomes large, the atomization base 231 is moved in an axial direction opposite to the suction nozzle assembly 1 as the rotation of the connecting base 232 so that the openings 233 opened at one end of the atomization base 231 is axially close to the first e-liquid guide hole 212 and then communicates with the first guide hole 212, an end of the e-liquid guide 221 provided in the openings 233 also communicates with the first e-liquid guide hole 212 to obtain the e-liquid in the e-liquid storage cavity 33. At this time, the heating wire assembly 22 is located at the same horizontal position as the first e-liquid guide hole 212, the first e-liquid guide hole 212 is in an open state, and the atomization assembly is in a normal operation state.

Continue to rotate the connecting base 232, the first protrusions 234*a* are also abutted against the second recesses 235*b* when the second protrusions 235*a* are abutted against the first recesses 234*b*, at this time, the first engaging portion 234 and the second engaging portion 235 are fully engaged and the gap there between is minimized. The atomization base 231 moves in an axial direction close to the suction nozzle assembly 1 as the rotation of the connecting base 232, the openings 233 opened at the end of the atomization base 231 is axially away from the first e-liquid guide hole 212 until the openings 233 are completely staggered from the first e-liquid guide hole 212, the heating wire assembly 22 provided in the openings 233 is also remote from the first e-liquid guide hole 212 until the heating wire assembly 22 and the first e-liquid guide hole 212 are completely isolated by a side wall surface of the atomization base 231. At this time, the heating wire assembly 22 is located at a different horizontal position with the first e-liquid guide hole 212, the first e-liquid guide hole 212 is in a close state, and the atomization assembly is in a non normal operation state.

However, combine FIG. 2 and FIG. 8, with a rotation of the connecting base 232, when the second protrusions 235*a* are switched from the abutment against the first protrusions 234*a* to the abutment against the first recesses 234*b*, the atomization base 231 should be moved toward one end close to the suction nozzle assembly 1 with the switch so that the openings 233 can be moved opposite to the first e-liquid guide hole 212 to close the first e-liquid guide hole 212. However, when placed in FIG. 2, the atomization base 231 under an action of gravity can not spontaneously complete this movement, namely can not be automatically reset, it needs to be helped with external force, this increases a complexity and difficulty of an operation.

In order to solve this problem, it is preferable that the internal electrode 24 in the present embodiment is an elastic electrode, and a second elastic member 242 is provided at one end of the internal electrode 24 which is abutted against the battery assembly 4, so that the abutment between engaging end surfaces of the atomization base 231 and the connecting base 232 is brought into an elastic contact, and a reliability of the abutment between the two engaging end surfaces is increased, and meanwhile the automatic resetting of the atomization base 231 can be achieved.

When the second protrusions 235*a* are abutted against the first protrusions 234*a*, a distance between the atomization base 231 and the battery assembly 4 is shortest, and the second elastic member 242 is compressed to ensure that the second protrusions 235*a* are reliably abutted against the first protrusions 234*a*; when the second protrusions 235*a* abut on the first recesses 234*b*, the second elastic member 242 pushes the atomization base 231 in an axial direction opposite to the battery assembly 4 by an elastic restoring force, thereby realizing the automatic resetting of the atomization base 231.

Preferably, an inner wall surface of the atomization base 231 is provided with a guide projection 231*c* along an axial direction of the atomization base 231, an inner wall surface of the connecting base 232 is correspondingly provided with a guide groove (not labeled in drawings) matched with the guide projection 231*c*, so as to ensure that the atomization base 231 can move in the axial direction of the atomization sleeve 21 and to prevent the atomization base 231 from rotating as the connecting base 232 rotates.

Preferably, the first protrusions 234*a* are provided with positioning grooves or a positioning protrusions on end surfaces of the first protrusions 234*a*; and the second protrusions 235*a* are provided with positioning grooves or positioning protrusions on end surfaces of the second protrusions 235*a*, so as to ensure that the first protrusions 234*a* and the second protrusions 235*a* can be reliably held against each other to prevent slippage and the like.

Embodiment 2: Referring to FIG. 2 with a Combination with FIGS. 9 to 12

The present embodiment differs from the first embodiment in that the structure of the first engaging portion 234 and the second engaging portion 235 is different, the first engaging portion 234 extends from an end surface of the atomization base 231 in an axial direction close the connecting base 232, the second engaging portion 235 extends from an end surface of the connecting base 232 in an axial direction close to the atomization base 231 for abutting against the first engaging portion 234.

The first engaging portion 234 is also provided with a plurality of first protrusions 234*a* spaced apart from each other with a predetermined distance and first recesses 234*b* located between two adjacent first protrusions 234*a*, the second engaging portion 235 is provided with a plurality of second protrusions 235*a* spaced apart from each other with a predetermined distance and second recesses 235*b* located between two adjacent second protrusions 235*a*.

Rotate the connecting base 232, when the second protrusions 235*a* are abutted against the first protrusions 234*a*, a gap between the first engaging portion 234 and the second engaging portion 235 becomes large, the atomization base 231 is moved in an axial direction close to the suction nozzle assembly 1 as the rotation of the connecting base 232 so that the openings 233 opened at one end of the atomization base 231 is axially close to the first e-liquid guide hole 212 and then communicates with the first guide hole 212, an end of the e-liquid guide 221 also communicates with the first e-liquid guide hole 212, the heating wire assembly 22 is located at the same horizontal position as the first e-liquid guide hole 212. Then the first e-liquid guide hole 212 is in an open state, and the atomization assembly is in a normal operation state.

Continue to rotate the connecting base 232, when the second protrusions 235*a* are abutted against the first recesses 234*b*, the first engaging portion 234 and the second engaging portion 235 are fully engaged and the gap there between is minimized. The atomization base 231 moves in an axial direction opposite to the suction nozzle assembly 1 as the rotation of the connecting base 232, the openings 233 is away from the first e-liquid guide hole 212 along an axial direction of the suction nozzle assembly 1 until the openings 233 are completely staggered from the first e-liquid guide hole 212, the heating wire assembly 22 and the first e-liquid guide hole 212 are completely isolated by a side wall surface of the atomization base 231. Then the heating wire assembly 22 is located at a different horizontal position with the first e-liquid guide hole 212, the first e-liquid guide hole 212 is in a close state, and the atomization assembly is in a no normal operation state.

In the present embodiment, the e-liquid inlet control structure 23 further comprises a first elastic member 237 defined between the atomization base 231 and the atomization sleeve 21, an outer wall surface of the atomization base 231 is provided with a stopper flange 238, the outer wall surface of the atomization base 231 is close to the first engaging portion 234, two ends of the first elastic member 237 are respectively abutted against the stopper flange 238 and an inner wall of the atomization sleeve 238, respectively, so that an automatic resetting of the atomization base 231 can be achieved.

When the second protrusions 235*a* are abutted against the first protrusions 234*a*, a distance between the atomization base 231 and the battery assembly 4 is largest, and the first elastic member 237 is compressed, the second elastic member 242 presses the atomization base 231 under an action of an elastic restoring force to ensure a reliable elastic abutment between the second protrusions 235*a* and the first protrusions 234*a*.

When the second protrusions 235*a* are abutted against the first recesses 234*b*, a distance between the atomization base 231 and the battery assembly 4 is shortest, and the second elastic member 242 is compressed, the first elastic member 237 pushes the atomization base 231 in an axial direction close to the battery assembly 4 under an action of an elastic restoring force, thereby realizing the automatic resetting of the atomization base 231.

Figure 13:
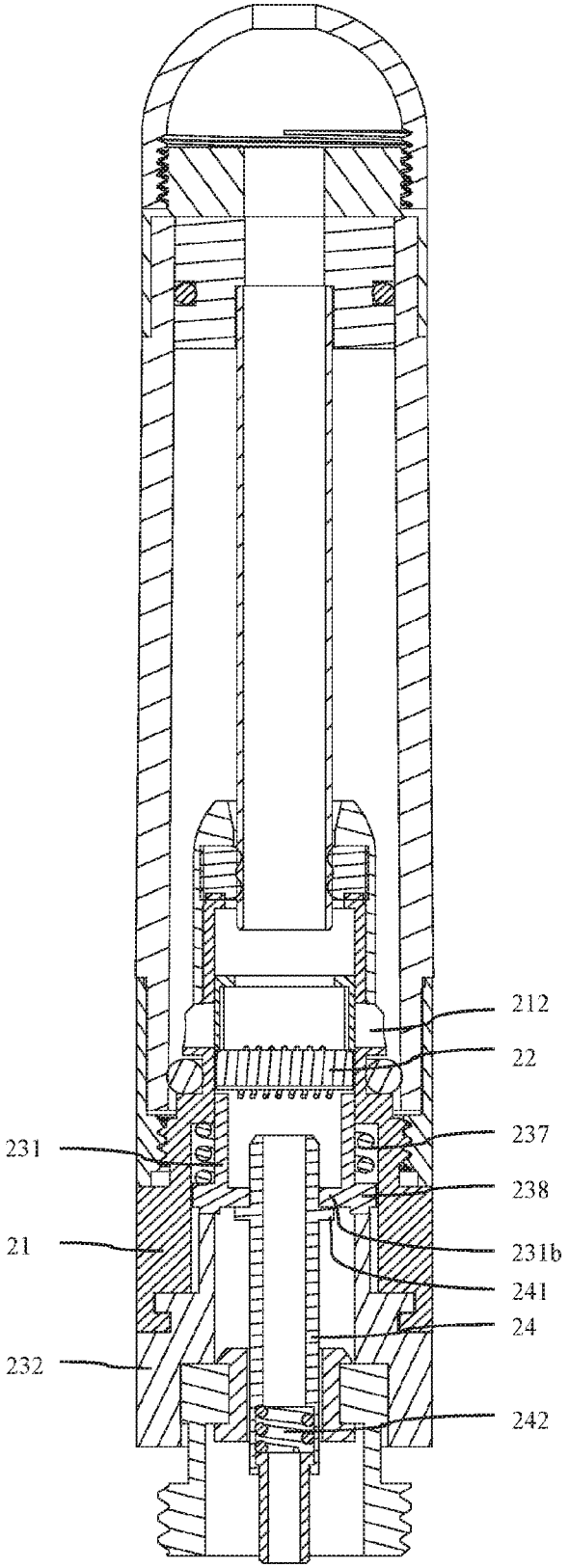
FIG. 13 is a structural schematic view an atomization assembly of an electronic cigarette provided in a third preferred embodiment of the present invention.

Embodiment 3: Referring to FIG. 13

The present embodiment differs from the foregoing embodiments in that the engaging structure is not provided between the atomization base 231 and the connecting base 232, the atomization base 231 is movable in an axial direction of the atomization sleeve 21, and the connecting base 232 is engaged with the atomizing sleeve 21, whether or not the connecting base 232 can be rotated relative to the atomization sleeve 21 does not affect an application of the present embodiment, and is not particularly limited thereto.

In the present embodiment, a reciprocating movement of the atomization base 231 in the axial direction of the atomizing sleeve 21 is realized by a pushing force of the battery assembly 4 and an elastic restoring force of the first elastic member 237. The second elastic member 242 acts primarily as a buffer.

When the battery assembly 4 is connected to the atomization assembly, the battery assembly 4 pushes the atomization base 231 in an axial direction close to the suction nozzle assembly 1 through the internal electrode 24, the internal electrode 24 is abutted against the battery assembly 4, so that a distance between the atomization base 231 and the battery assembly 4 becomes largest, then the first elastic member 237 and the second elastic member 242 are both compressed, the openings 233 is close to the first e-liquid guide hole 212 as the movement of the atomization base 231 and then the openings 233 communicate with the first guide hole 212, the heating wire assembly 22 is located at the same horizontal position as the first e-liquid guide hole 212. Then the first e-liquid guide hole 212 is in an open state, and the atomization assembly is in a normal operation state.

When the battery assembly 4 is disconnected to the atomization assembly, the battery assembly 4 is disengaged from the internal electrode 24, and the atomization base 231 loses a driving force in the axial direction, the first elastic member 237 pushes the atomization base 231 in an axial direction opposite to the battery assembly 4 under an action of an elastic restoring force, thereby realizing the automatic resetting of the atomization base 231, then the first elastic member 237 and the second elastic member 242 are both released to ensure the atomization base 231 is abutted against an end surface of the connecting base 232. The openings 233 is away from the first e-liquid guide hole 212 as the movement of the atomization base 231 until the openings 233 are completely staggered with the first e-liquid guide hole 212, so that the heating wire assembly 22 is located at a different horizontal position with the first e-liquid guide hole 212. Then the first e-liquid guide hole 212 is in a close state, and the atomization assembly is in a non normal operation state.

With applications of the electronic cigarette in the present embodiment, it is only necessary to install the battery assembly 4 when smoking, and to remove the battery assembly 4 when the electronic cigarette is not in use, and it is not necessary to switch the connecting base 323 and the like structure.

Figure 14:
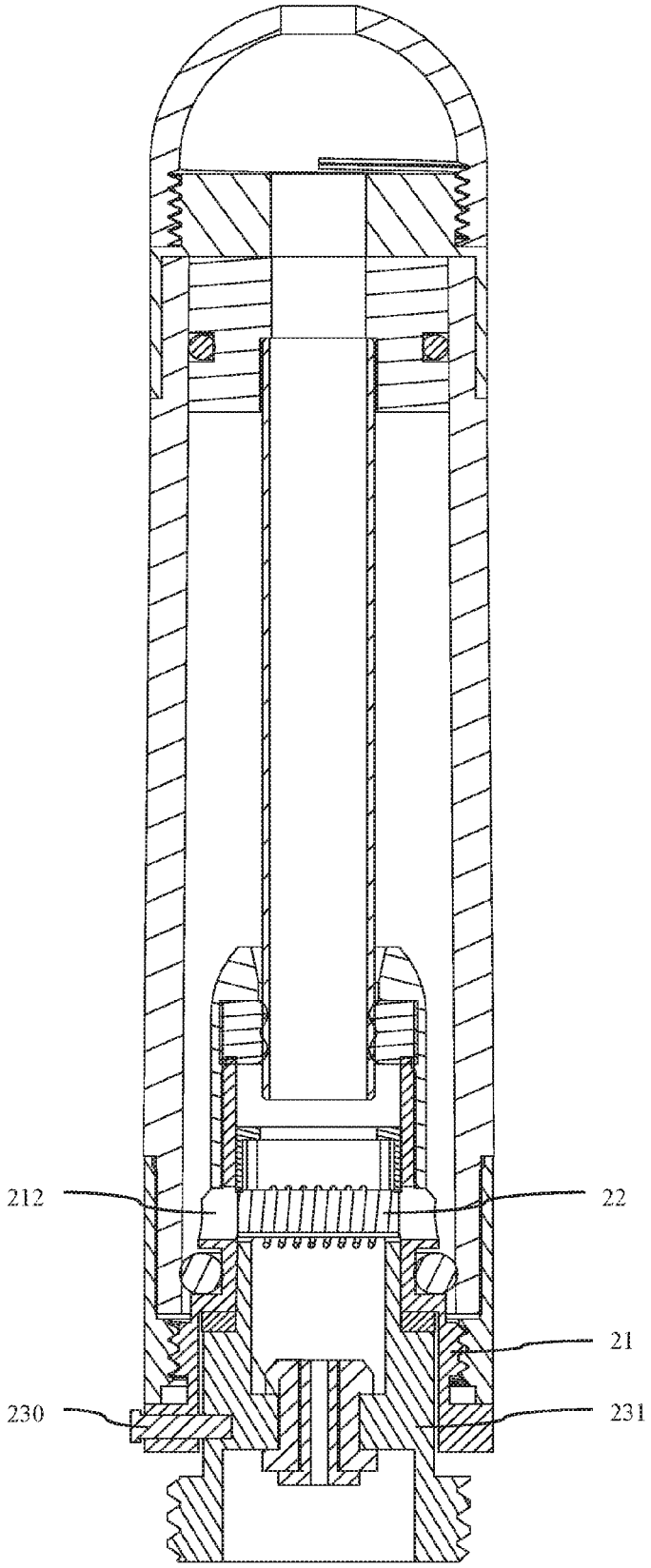
FIG. 14 is a structural schematic view an atomization assembly of an electronic cigarette provided in a fourth preferred embodiment of the present invention.
Figure 15:
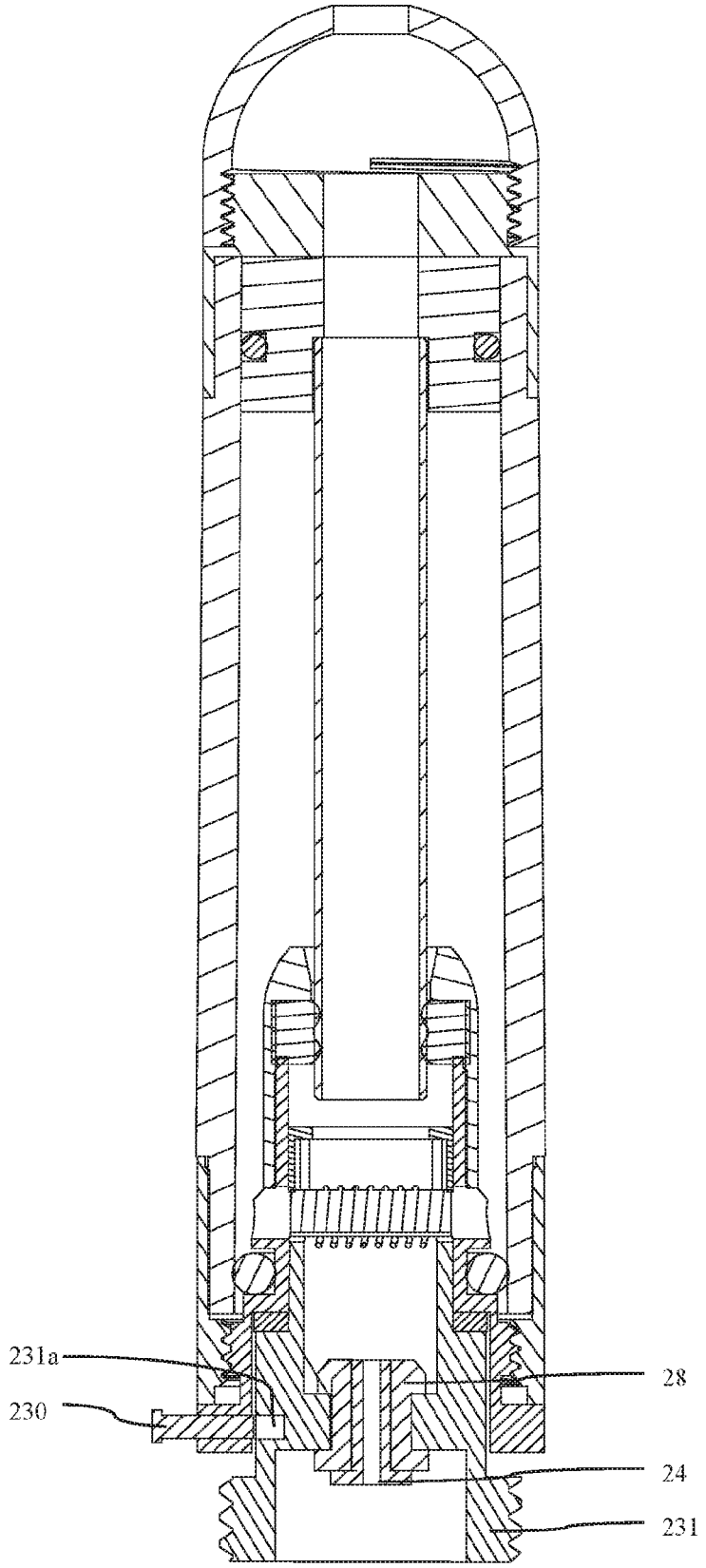
FIG. 15 is a structural schematic view of the atomization assembly of FIG. 14 when the connecting base is in a rotatable state.

Embodiment 4: Referring to FIG. 14 and FIG. 15

The present embodiment differs from the foregoing embodiments in that the e-liquid inlet control structure 23 comprises an atomization base 231 rotatably inserted in the atomization sleeve 21, the atomization base 231 is also symmetrically provided with openings 233 for installing the heating wire assembly 22. The atomization base 231 works as an external electrode and is electrically isolated from the internal electrode 24 by the insulating sleeve 28, the atomization base 231 and the internal electrode 24 is made of a metal material or coated with a conductive material.

Rotate the atomization base 231 to enable that the openings 233 are communicated with the first e-liquid guide hole 212, then the first e-liquid guide hole 212 is in an open state, and the atomization assembly is in a normal operation state.

Rotate the atomization base 231 to enable that the openings 233 are completely isolated from the first e-liquid guide hole 212, so that the heating wire assembly 22 installed at the openings 233 is completely isolated from the first e-liquid guide hole 212 by a side wall surface of the atomization base 231, then the first e-liquid guide hole 212 is in a close state, and the atomization assembly is in a non normal operation state.

In the present embodiment, the arrangement of the connecting base 232 is canceled, and the heating wire assembly 22 and the first e-liquid guide hole 212 are always at the same horizontal position, that is, the atomization base 231 rotates only with respect to the atomization sleeve 21 and does not occur an axial movement.

It is preferred that the e-liquid inlet control structure 23 further comprises a positioning pin 230, the positioning pin 230 detachably mounted on the atomization sleeve 21, one end of the positioning pin 230 extends outside the atomization assembly for the user to hold. Correspondingly, the atomization base 231 is provided with a positioning hole 231*a* matched with the positioning pin 230.

When the user needs to use the electronic cigarette, it is necessary to unplug the positioning pin 230 and then rotate the atomization base 231 to open the first e-liquid guide hole 212; When the user does not need to use the electronic cigarette, the atomization base 231 is rotated to close the first e-liquid guide hole 212 and then the positioning pin 230 is inserted to prevent the atomization base 231 from rotating due to erroneous contact.

Each of the embodiments of the present specification is described in a progressive manner, specification of each embodiment is focused on the differences from other embodiments, and the same or similar parts between the various embodiments may be referred to each others.

While the embodiments of the present application are described with reference to the accompanying drawings above, the present application is not limited to the above-mentioned specific implementations. In fact, the above-mentioned specific implementations are intended to be exemplary not to be limiting. In the inspiration of the present application, those ordinary skills in the art can also make many modifications without breaking away from the subject of the present application and the protection scope of the claims. All these modifications belong to the protection of the present application.

The invention claimed is:

1. An atomization assembly configured for forming an electronic cigarette with a battery assembly (4), comprising a suction nozzle assembly (1), an atomization core (2) and an e-liquid cup assembly (3), the atomization core (2) and the suction nozzle assembly (1) are respectively arranged at two ends of the e-liquid cup assembly (3); wherein the e-liquid cup assembly (3) comprises an e-liquid storage sleeve (31) and a vent pipe (32), the vent pipe (32) is arranged in the e-liquid storage sleeve (31) for discharging smoke obtained by an atomization of the atomization core (2) to the suction nozzle assembly (1), an e-liquid storage cavity (33) is formed between the e-liquid storage sleeve (31) and the vent pipe (32), one end of the e-liquid storage sleeve (31) is provided with an open end communicating with the e-liquid storage cavity (33), the atomization core (2) is detachably connected to the e-liquid cup assembly (3) and at least one end of the atomization core (2) is inserted into the e-liquid storage cavity (33) from the open end;

wherein the atomization core (2) comprises an atomization sleeve (21) and a heating wire assembly (22), the atomization sleeve (21) is provided with an atomization cavity (211) for receiving the heating wire assembly (22) to atomize e-liquid, and a first e-liquid guide hole (212) allowing the e-liquid in the e-liquid storage cavity (33) to flow into the atomization cavity (211) is defined on a side wall of the atomization sleeve (21); and wherein the atomization core (2) further comprises an e-liquid inlet control structure (23), the e-liquid inlet control structure (23) is sleeved in the atomization sleeve (21) rotatably or movably in an axial direction of the atomization sleeve (21), openings (233) for mounting the heating wire assembly (22) are arranged on the e-liquid inlet control structure (23), and when the e-liquid inlet control structure (23) is rotated or axially moved, the openings (233) and the first e-liquid guide hole (212) are communicated or completely staggered, so as to open or close the first e-liquid guide hole (212).

2. The atomization assembly according to claim 1, wherein the e-liquid inlet control structure (23) comprises an atomization base (231) and a connecting base (232), the connecting base (232) is rotatably provided at one end of the atomization base (231), the openings (233) are provided at the other end of the atomization base (231); the atomization base (231) is abutted against the connecting base (232), abutting end surfaces of the atomization base (231) and the connecting base (232) are provided with mutually matched engaging structures, respectively, the engaging structures are configured for enabling the atomization base (231) move along the axial direction of the atomization sleeve (21) to communicate the first e-liquid guide hole (212) with the heating wire assembly (22) or to isolate the first e-liquid guide hole (212) from the heating wire assembly (22), when rotating the connecting base (232).

3. The atomization assembly according to claim 2, wherein the atomization base (231) is elastically abutted against the connecting base (232).

4. The atomization assembly according to claim 2, wherein the connecting base (232) is rotatably sleeved outside the atomization base (231), an outer wall of the one end of the atomization base (231) projects outwardly to form a first engaging portion (234), an inner wall of one end of the connecting base (232) protrudes inwardly to form a second engaging portion (235), and the first engaging portion (234) and the second engaging portion (235) are the engaging structures whose surfaces are abutted against each other and matched with each other;

wherein the first engaging portion (234) is provided with a plurality of first protrusions (234*a*) spaced apart from each other with a predetermined distance and first recesses (234*b*) located between the first protrusions (234*a*), the second engaging portion (235) is provided with a plurality of second protrusions (235*a*) spaced apart from each other with a predetermined distance and second recesses (235*b*) located between the second protrusions (235*a*); and wherein the first e-liquid guide hole (212) is communicated with the heating wire assembly (22) when the connecting base (232) is rotated to ensure the first protrusions (234*a*) are abutted against the second protrusions (235*b*); the first e-liquid guide hole (212) is isolated from the heating wire assembly (22) by a side wall of the atomization base (231) when the first protrusions (234*a*) are abutted against the second recesses (235*b*).

5. The atomization assembly according to claim 4, wherein an outer wall surface of the atomization base (231) is provided with a guide projection (231*c*) along an axial direction of the atomization base (231), an inner wall surface of the connecting base (232) is correspondingly provided with a guide groove matched with the guide projection (231*c*).

6. The atomization assembly according to claim 4, wherein end surfaces of the first protrusions (234*a*) are provided with positioning grooves or positioning protrusions; and end surfaces of the second protrusions (235*a*) are provided with positioning protrusions or positioning grooves matched with the first protrusions (234*a*).

7. The atomization assembly according to claim 2, wherein the atomization base (231) is mutually abutted against an end surface of the connecting base (232), an end surface of the atomization base (231) extends to form a first engaging portion (234) in an axial direction toward to the connecting base (232); an end surface of the connecting base (232) is provided with a second engaging portion (235) configured for being mutually abutted against the first engaging portion (234);

wherein the first engaging portion (234) is provided with a plurality of first protrusions (234*a*) spaced apart from each other with a predetermined distance and first recesses (234*b*) located between the first protrusions (234*a*), the second engaging portion (235) is provided with a plurality of second protrusions (235*a*) spaced apart from each other with a predetermined distance and second recesses (235*b*) located between the second protrusions (235*a*);

wherein the first e-liquid guide hole (212) is communicated with the heating wire assembly (22) when the connecting base (232) is rotated to ensure the first protrusions (234*a*) are abutted against the second protrusions (235*b*); the first e-liquid guide hole (212) is isolated from the heating wire assembly (22) by a side wall of the atomization base (231) when the first protrusions (234*a*) are abutted against the second recesses (235*b*).

8. The atomization assembly according to claim 7, wherein the e-liquid inlet control structure (23) further comprises a first elastic member (237) defined between the atomization base (231) and the atomization sleeve (21), an outer wall surface of the atomization base (231) is provided with a stopper flange (238), the outer wall surface of the atomization base (231) is close to the first engaging portion (234), two ends of the first elastic member (237) are respectively abutted against the stopper flange (238) and an inner wall of the atomization sleeve (231).

9. The atomization assembly according to claim 2, wherein the openings (233) are U-shaped openings which are provided on an end surface of the atomization base (231), the end surface of the atomization base (231) is opposite to the connecting base (232), and two ends of the heating wire assembly (22) are respectively engaged in the openings (233).

10. The atomization assembly according to claim 2, wherein the atomization core (2) further comprises an internal electrode (24) for supplying electrical power to the heating wire assembly (22), one end of the internal electrode (24) is inserted in and fixed to the atomization base (231), and the other end of the internal electrode (24) is elastically abutted against the battery assembly (4) for elastically abutting the atomization base (231) against the connecting base (232).

11. The atomization assembly according to claim 1, wherein the e-liquid inlet control structure (23) comprises an atomization base (231), a connecting base (232) and a first elastic member (237), the atomization base (231) moves along the axial direction of the atomization sleeve (21), the connecting base (232) is fixedly defined at one end of the atomization sleeve (21), the first elastic member (237) is defined between the atomization sleeve (21) and the atomization base (231), an end surface of the atomization base (231) is mutually abutted against an end surface of the connecting base (232), the openings (233) are provided at the other end of the atomization base (231);

wherein the atomization core (2) further comprises an internal electrode (24) for supplying electrical power to the heating wire assembly (22), one end of the internal electrode (24) is clamped and fixed in the atomization base (231), and the other end of the internal electrode (24) is elastically abutted against the battery assembly (4); and wherein installing the battery assembly (4) enables the atomization base (231) to be axially moved until the first e-liquid guide hole (212) is communicated with the heating wire assembly (22), and the first elastic member (237) is compressed; with disassembling the battery assembly (4), under a restoring force of the first elastic member (237), the atomization base (231) is axially moved until the first e-liquid guide hole (212) is isolated from the electric heating wire assembly (22) by a side wall surface of the atomization base (231).

12. The atomization assembly according to claim 11, wherein an outer wall surface of the atomization base (231) is provided with a stopper flange (238), two ends of the first elastic member (237) are respectively abutted against the stopper flange (238) and an inner wall of the atomization sleeve (238).

13. The atomization assembly according to claim 11, wherein the internal electrode (24) is elastically abutted against the battery assembly (4).

14. The atomization assembly according to claim 11, wherein an inner wall of the atomization base (231) protrudes inwardly to form a fixed projection (231*b*), an outer wall of the internal electrode (24) projects outwardly to form a raised portion (241), an end of the internal electrode (24) passes through the fixed projection (231*b*) so that the raised portion (241) is abutted against the fixed projection (231*b*) along the axial direction of the atomization sleeve (21).

15. The atomization assembly according to claim 1, wherein the e-liquid inlet control structure (23) comprises an atomization base (231) rotationally inserted into the atomization sleeve (21), the openings (233) are symmetrically arranged on the atomization base (231) for mounting the heating wire assembly (22), two ends of the heating wire assembly (22) are clamped in the openings (233); and wherein with a rotation of the atomization base (231), the openings (233) are communicated with the first e-liquid guide hole (212) or completely isolated from the first e-liquid guide hole (212).

16. The atomization assembly according to claim 15, wherein the e-liquid inlet control structure (23) further comprises a positioning pin (230), the positioning pin (230) is detachably mounted on the atomization sleeve (21), the atomization base (231) is provided with a positioning hole (231*a*) matched with the positioning pin (230).

17. The atomization assembly according to claim 1, wherein the heating wire assembly (22) comprises an e-liquid guide member (221) for communicating with the first e-liquid guide hole (212), and a heating wire (222) wound around the e-liquid guide member (221), the e-liquid guide member (221) is configured for transferring the e-liquid obtained from the e-liquid storage cavity (33) for the heating wire (222) to heat and atomize.

18. An electronic cigarette, wherein the electronic cigarette comprises the atomization assembly according to claim 1 and a battery assembly (4) configured for supplying electrical power to the atomization assembly.

* * * * *